US010226683B2

(12) United States Patent
Chen

(10) Patent No.: US 10,226,683 B2
(45) Date of Patent: Mar. 12, 2019

(54) IN-LINE WHEELED BOARD DEVICE

(71) Applicant: Shane Chen, Camas, WA (US)

(72) Inventor: Shane Chen, Camas, WA (US)

( * ) Notice: Subject to any disclaimer, the term of this patent is extended or adjusted under 35 U.S.C. 154(b) by 0 days.

(21) Appl. No.: 15/007,200

(22) Filed: Jan. 26, 2016

(65) Prior Publication Data

US 2018/0221753 A1 Aug. 9, 2018

(51) Int. Cl.
*A63C 17/00* (2006.01)
*A63C 17/01* (2006.01)

(52) U.S. Cl.
CPC ..... *A63C 17/0033* (2013.01); *A63C 17/016* (2013.01); *A63C 17/012* (2013.01)

(58) Field of Classification Search
CPC .. A63C 17/0033; A63C 17/016; A63C 17/012
See application file for complete search history.

(56) References Cited

U.S. PATENT DOCUMENTS 2,843,426 A * 7/1958 Nojima ..... B60B 3/048 16/24
2,996,306 A * 8/1961 Johnson ..... A63C 17/08 280/11.115
3,663,031 A * 5/1972 Young ..... A63C 17/08 280/11.204
4,045,096 A * 8/1977 Lidov ..... B60B 3/048 16/26
4,150,838 A * 4/1979 Lappage ..... A63C 17/01 280/843
4,363,493 A * 12/1982 Veneklasen ..... A63C 17/08 280/11.204
4,445,699 A * 5/1984 Darasko ..... A63C 17/045 280/11.223
4,991,861 A * 2/1991 Carn ..... B62B 15/001 280/11.208
5,048,851 A * 9/1991 Alarcon ..... A63C 17/0026 280/11.225
5,071,196 A * 12/1991 Sbarro ..... B60B 3/048 301/1
5,160,155 A * 11/1992 Barachet ..... A63C 17/0033 280/11.209
5,248,019 A * 9/1993 Sbarro ..... B60B 3/048 180/219
5,419,619 A * 5/1995 Lew ..... B60B 3/048 301/1

(Continued)

FOREIGN PATENT DOCUMENTS

CA 02324645 A * 10/2000 ..... A63C 17/04

*Primary Examiner* — Jacob B Meyer
(74) *Attorney, Agent, or Firm* — Steven J. Sullivan

(57) ABSTRACT

A wheeled board device with forward and rearward in-line wheel structures attached to a user platform. The forward wheel may have a forward tilt axle or be otherwise direction-biased to permit lean-based turning. The rear wheel may be singular or comprise two tires or the like and be motorized or not. The wheels are preferably large to more readily handle surface irregularities. A self-balancing wheelie mode is disclosed in one embodiment. Other embodiments include placement of the forward tilt axle within or without the envelope of the front wheel. The user platform is below the top of the rear wheel and preferably near the axis of the rear wheel, among other features.

20 Claims, 4 Drawing Sheets

(56) References Cited

U.S. PATENT DOCUMENTS 5,826,674 A * 10/1998 Taylor ..... A63C 17/12 180/219
6,050,357 A * 4/2000 Staelin ..... A63C 17/004 180/65.1
6,145,857 A * 11/2000 Bernstein ..... A63C 17/0006 280/11.208
6,224,080 B1 * 5/2001 Ross ..... B60B 3/048 280/260
6,241,264 B1 * 6/2001 Page ..... A63C 17/045 280/11.19
6,254,113 B1 * 7/2001 Dornan ..... A63C 5/035 280/11.227
6,338,494 B1 * 1/2002 Killian ..... A63C 17/01 280/87.042
6,382,640 B1 * 5/2002 Killian ..... A63C 17/08 280/11.24
6,398,237 B1 * 6/2002 Attey ..... A63C 17/01 188/29
6,705,630 B1 * 3/2004 Karpman ..... A63C 17/01 280/253
6,832,765 B1 * 12/2004 Walton ..... A63C 17/01 280/11.19
7,053,288 B2 * 5/2006 Iwai ..... A63C 5/06 280/87.042
7,053,289 B2 * 5/2006 Iwai ..... A63B 25/08 280/87.042
7,138,774 B2 * 11/2006 Negoro ..... A63C 17/0046 318/139
7,147,235 B2 * 12/2006 West ..... A63C 17/013 280/87.042
7,172,205 B1 * 2/2007 Vujtech ..... A63C 17/004 280/87.021
7,193,376 B2 * 3/2007 Negoro ..... A63C 17/0046 180/181
7,198,280 B2 * 4/2007 Hara ..... A63C 17/0033 280/29
7,213,823 B1 * 5/2007 Vujtech ..... A63C 17/004 280/87.021
7,445,069 B2 * 11/2008 Negoro ..... A63C 17/01 180/180
7,458,435 B2 * 12/2008 Negoro ..... A63C 17/12 180/180
7,669,681 B2 * 3/2010 Lee ..... A63C 17/045 180/221
D620,994 S * 8/2010 Jordan ..... D21/765
7,980,568 B2 * 7/2011 Chen ..... A63C 17/01 280/11.24
8,113,524 B2 * 2/2012 Karpman ..... A63C 17/016 280/11.19
8,226,096 B2 * 7/2012 Reyes, Jr. ..... A63C 17/016 280/11.226
8,376,378 B2 * 2/2013 Keel ..... B62K 11/04 180/227
8,464,822 B2 * 6/2013 Spector ..... B62K 3/00 180/181
8,523,212 B2 * 9/2013 Ryan ..... B62K 15/008 180/206.1
8,579,306 B2 * 11/2013 Lewis ..... A63C 17/0046 280/87.042
8,746,383 B2 * 6/2014 Basadzishvili ..... B60G 3/01 180/65.51
9,327,182 B1 * 5/2016 Meak ..... A63C 17/04
9,393,483 B2 * 7/2016 Tan ..... A63C 17/12
9,616,318 B2 * 4/2017 Rogers ..... A63C 17/12
D785,737 S * 5/2017 Meak ..... D21/765
9,943,750 B2 * 4/2018 Rogers ..... A63C 17/12
9,999,827 B2 * 6/2018 Wood ..... A63C 17/12
10,058,766 B2 * 8/2018 Ma ..... A63C 17/12
2004/0036248 A1 * 2/2004 Karpman ..... A63C 17/01 280/253
2005/0160902 A1 * 7/2005 Iwai ..... A63B 25/08 84/723
2005/0211078 A1 * 9/2005 Iwai ..... A63C 5/06 84/723
2006/0038520 A1 * 2/2006 Negoro ..... A63C 17/12 318/466
2006/0186842 A1 * 8/2006 Negoro ..... A63C 17/0046 318/139
2006/0213711 A1 * 9/2006 Hara ..... A63C 17/0033 180/181
2010/0108423 A1 * 5/2010 Keel ..... B62K 11/04 180/227
2011/0074127 A1 * 3/2011 Karpman ..... A63C 17/016 280/63
2011/0175310 A1 * 7/2011 Lewis ..... A63C 17/0046 280/87.042
2011/0181014 A1 * 7/2011 Ryan ..... B62K 15/008 280/263
2011/0209938 A1 * 9/2011 Basadzishvili ..... B60G 3/01 180/305
2012/0175179 A1 * 7/2012 Spector ..... B62K 3/00 180/219
2012/0232734 A1 * 9/2012 Pelletier ..... A63C 17/12 701/22
2013/0087983 A1 * 4/2013 Ngai ..... B60B 19/00 280/87.041
2014/0262574 A1 * 9/2014 Rodgers ..... A63C 17/12 180/167
2016/0001166 A1 * 1/2016 Kumada ..... A63C 17/006 280/87.03
2016/0067588 A1 * 3/2016 Tan ..... A63C 17/12 180/181
2016/0107070 A1 * 4/2016 Middleton ..... A63C 17/012 280/87.042
2017/0165561 A1 * 6/2017 Rogers ..... A63C 17/12
2018/0111039 A1 * 4/2018 Wood ..... A63C 17/12
2018/0147478 A1 * 5/2018 Wood ..... A63C 17/12
2018/0178111 A1 * 6/2018 Ma ..... A63C 17/12
2018/0221753 A1 * 8/2018 Chen ..... A63C 17/0033

* cited by examiner

IN-LINE WHEELED BOARD DEVICE

CROSS REFERENCE TO RELATED APPLICATIONS

This application claims the benefit of U.S. Provisional Application No. 62/107,995, filed Jan. 26, 2015, entitled Wheeled Board Device Having an Interiorly Disposed Turning Axis and having the same inventor as above.

FIELD OF THE INVENTION

The present invention relates to wheeled-board or skateboard devices (manual or motorized) and, more specifically, to such devices that have linearly disposed or "in-line" front and rear wheel assemblies.

BACKGROUND OF THE INVENTION

The prior art includes various wheel board and skateboard devices. Some embodiments have conventional trucks (two sets of paired wheels, each pair mounted on a substantially horizontally disposed axle), while other embodiments may have wheels that are larger than conventional truck wheels and/or otherwise arranged. Four, three and two wheel embodiments are known.

One prior art device is disclosed in U.S. Pat. No. 5,160,155, issued to Barachet for a Skateboard Having Two Wheels in Tandem. FIG. 2 of Barachet, a top plan view, illustrates that the two wheels are "in-line."

The prior art devices are disadvantageous for one or more of the following reasons, among others. Many prior art devices have small wheels that are more likely to be impeded by pebbles/small debris, cracks in sidewalks, and other surface irregularities, than larger wheels. Others, such as the device of Barachet, have cumbersome or awkwardly arranged turning axles, which may lead to elevated rider platforms, an axle that becomes a tripping hazard when mounting/dismounting or that can readily cause damage or be damaged (such as the extended, pointy turning axle of Barachet). Furthermore, these cumbersome arrangements negatively impact the look, feel, and use experience of the device.

In addition, known skateboards and wheeled-boards tend to be limited in their manner of propulsion. There is a need for wheel or skate board devices that offer alternative or multiple manners of propulsion and riding experiences. This increases the effectiveness and fun of the device for entertainment and transport, the latter being particularly important in this era of less-favorable attitudes towards automobile use—due to greenhouse gas emissions and lack of physical exercise concerns, among others.

SUMMARY OF THE INVENTION

Accordingly, it is an object of the present invention to overcome the shortcoming of the prior art.

It is another object of the present invention to provide a wheeled board device that has a relatively low rider platform for improved center of gravity yet with larger wheels for a smoother ride.

It is another object of the present invention to provide a wheeled board device that is motorized and affords self-balancing, particularly in "wheelie" mode.

And it is yet another object of the present invention to provide a wheeled board device that affords an improved look, feel and use experience.

These and related objects of the present invention are achieved by use of an in-line wheeled board device as described herein.

The attainment of the foregoing and related advantages and features of the invention should be more readily apparent to those skilled in the art, after review of the following more detailed description of the invention taken together with the drawings.

DETAILED DESCRIPTION

Figure 1:
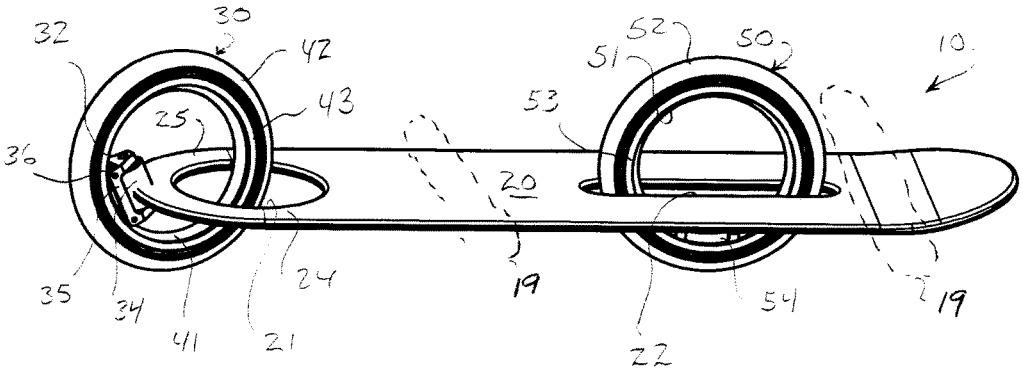
FIG. 1 is a perspective view of a wheeled board device in accordance with the present invention.

Referring to FIG. 1, a perspective view of a wheeled board device 10 in accordance with the present invention is shown. Device 10 may include a board 20 having an opening 21 that accommodates a front wheel 30 and an opening 22 that accommodates a rear wheel 50. Front wheel 30 may include rim 41 and tire 42, while rear wheel 50 may include rim 51 and tire 52. Dashed lines 19 indicate where a user might stand on board 20 during use.

Board 20 may be formed of any conventional skateboard or wheeled board material (including wood, fiberglass, plastic/resin, light weight metals, etc.) or any other suitable material.

In FIG. 1, board 20 is configured such that front opening 22 provides sufficient space for a turning front wheel and essentially defines two wheel attachment arms or members 24,25. A wheel mounting assembly 31 is preferably provided at the meeting place of the two arm members 24,25 (preferably substantially equidistant) and includes a turning axle 32 (mounted, in FIG. 1, in cylinder 33). A mounting bracket 35 may be movably (e.g., pivotally) coupled to axle 32, to permit wheel 30 to turn. Mounting bracket 35 is also preferably coupled to an inner rim 41 of wheel 30. An outer rim 43 may be coupled to rim 41 in such a manner that it rotates freely about rim 41. A plurality of rollers or ball bearings or the like may facilitate the rotation of outer rim 43 about rim 41.

Though one manner is described above, various ways of connecting to a wheel rim that provide adequate support and low friction movement of the wheel are known in the art and may be used here without departing from the present invention.

Axle 32 (and the axis of that axle) are preferably forward titled so that wheel 30 turns in response to leaning left or right and returns to a straight-forward direction of travel in the absence of such leaning. In the absence of a forward tilt, a spring bias may be used to permit wheel 30 to turn in response to a lean and yet return to a straight-ahead direction in the absence of that lean. The forward tilt or spring biased wheel may be referred to as a "direction-biased" caster arrangement.

FIG. 1 thus illustrates one manner of "interiorly" attaching a forward tilt turning axle within the "envelope" of the front wheel. In this context, the "envelope" is the volume substantially defined by tire 42 and two parallel planes that are respectively adjacent the outer two sides of the tire.

It should be recognized that other ways of attaching a forward tilt turning axle within the envelope of the front wheel may be done without departing from the present invention. For example, another such arrangement with tubular arm members is shown in FIGS. 2-5. It should be noted that arms 24,25 may be detachable (sliding out of larger platform 20 to permit wheel 30 to be serviced (i.e., tire 42 changed, rim 41/43 replaced, etc.).

Figure 2:
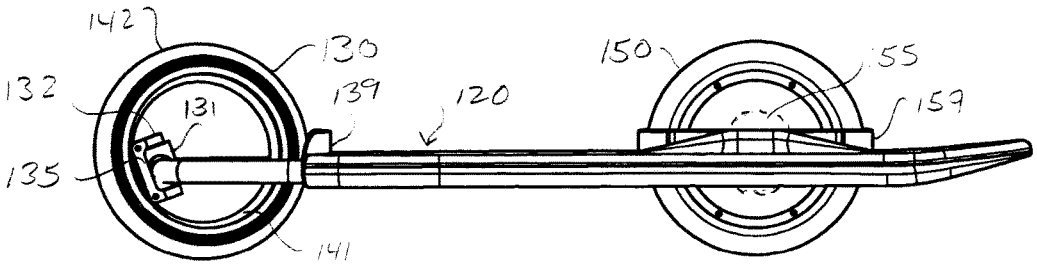
FIGS. 2-4 are a side elevation, perspective and bottom views, respectively, of a motorized-wheeled board device in accordance with the present invention.
Figure 3:
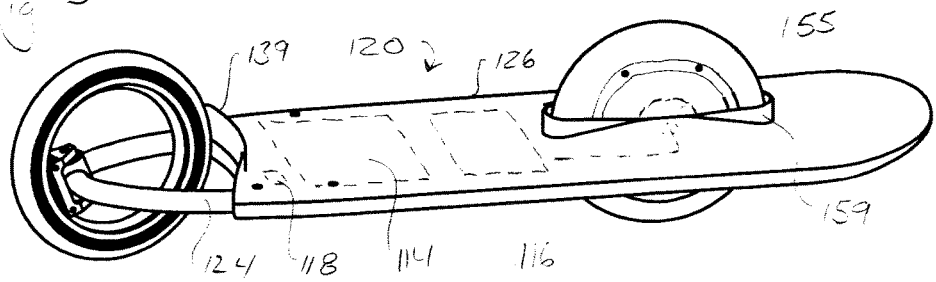
Figure 4:
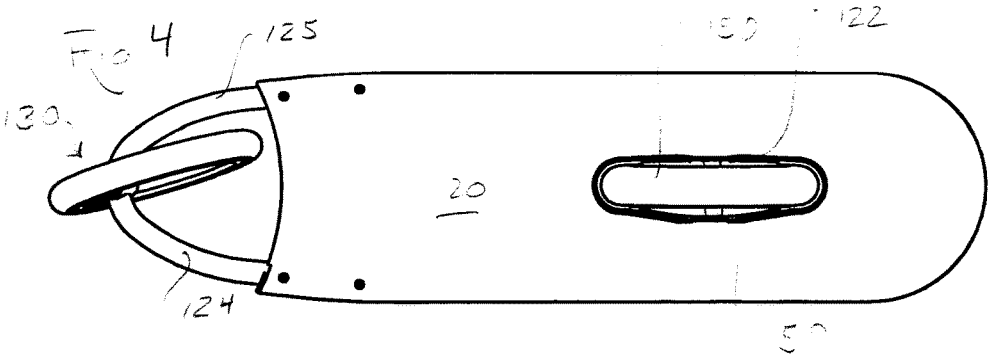

FIG. 1 illustrates a manual propulsion device while the embodiment of FIGS. 2-4 is motorized. Rear wheel 50 is mounted for free rotation. Wheel 50 may include an outer rim 53 that is rotatably coupled to fixed inner rim 51. A wheel mounting bracket (not shown due to perspective of figure) is preferably placed at the edge of and/or below slot 22 and coupled securely to the platform and inner rim. Suitable mounting assemblies for wheel 50 are known in the art.

Referring to FIGS. 2-4, side elevation, perspective and bottom views, respectively, of a motorized-wheeled board device 110 in accordance with the present invention are shown.

Device 110 includes a board 120 that has a housing 126 which may securely encase battery 114 and control electronics 116 and a gyroscopic position sensor 118. Two support arms 124,125 extend forward of the board and meet at wheel mounting assembly 131, similar to mounting assembly 31 of FIG. 1. The support arms may be formed of tubular material coupled to housing 126 or as an integral extension of the housing (or otherwise). As noted above for device 10, the support arms may be decoupled from platform 120 for servicing of wheel 130. Wheel 130 is coupled by mounting bracket 135 and rear wheel 150 fits within slot 122 of board 120. A motor 155 is preferably provided within wheel 150. Suitable hub motors are known in the art.

Wheel mounting assembly 131 preferably includes a front wheel turning axle 132 that is forward tilted. In general, device 110 may include components that are the same or similar to their analogous components in device 10.

While wheels 30,50 and 130 (and 230 and 250 below) have an "open" structure, as shown. This open structure is achieved by coupling to the rim of the wheel and not via a hub or hub-like arrangement. Wheel 150, however, has a "closed" structure to house hub motor 155 and related components. Wheel 150 may be mounted by axle 158. Board 120 may have a sloped or otherwise shaped surface that receives the opposing ends of axle 158. The platform may be at or below axle 158, or otherwise arranged. A lower height of platform achieves a lower center of gravity and thereby increases stability. Wheel guard or flanges 139,159 may protect a user's foot from sliding into a wheel, or wheel 150 above platform 120 may be covered in whole or in part.

In one embodiment of a motorized drive wheel, wheel 150 may be constructed in a manner similar to a motorized self-balancing unicycle wheel, such as that taught by U.S. Pat. No. 8,807,250 for a Powered Single-Wheeled Self-Balancing Vehicle for Standing User, issued to Shane Chen, the inventor herein, which is hereby incorporated by reference as those disclosed herein in its entirety. In this embodiment, the electronic control 116 may be configured such that the self-balancing aspects engage when front wheel 130 is lifted off the ground, as detected by position sensor 118 (or a pressure sensor or other). This, for example, permits a user to ride in a sustained manner in a "wheelie" position. Device 110 may be configured such that the position sensor must detect a threshold height before self-balancing wheelie mode is entered, or to detect that wheel 130 is on the ground (pressure sensor), or such that another sensed criteria is met. Various sensed criteria are known in the art.

An equilibrium wheel lift ("wheelie") position may be established at which a user can operate the device in unicycle (or unicycle-like) mode, moving the device forward and backward and at a varying speeds based on the displacement of board 120 from the raised equilibrium position.

In this particular embodiment, when the front wheel is brought back into contact with the ground (or brought below a threshold for self-balancing), the motorized drive mechanism is released and the user may control and propel the device manually, by pushing off with a foot or with a side-to-side twisting motion, or other.

Figure 5:
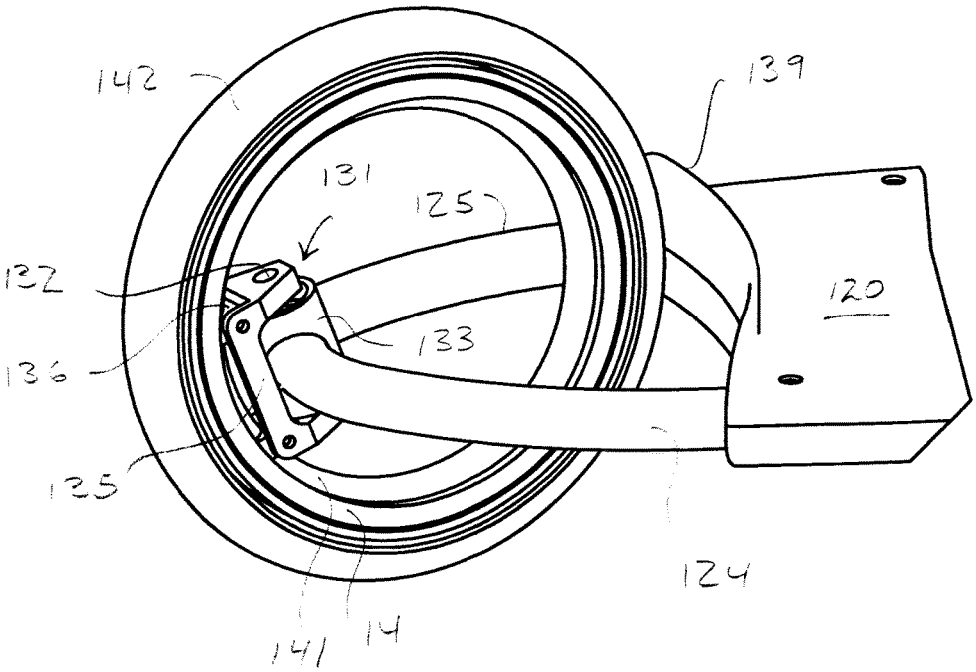
FIG. 5 is a close-up perspective view of the front wheel and wheel mounting assembly of the device of FIGS. 2-4.

Referring to FIG. 5, a close-up perspective view of front wheel 130 and wheel mounting assembly 131 is shown. Turning axle 132 preferably has a forward tilt to permit turning in response to a lean, propulsion through side-to-side twisting (tacking), and straight-forward travel in the absence of leaning. Mounting bracket 135 is movably coupled to axle 132, and mounts the turning axle to inner rim 141 of wheel 130. As discussed above for device 10, outer rim 143 is rotatably to inner rim 141.

Figure 6:
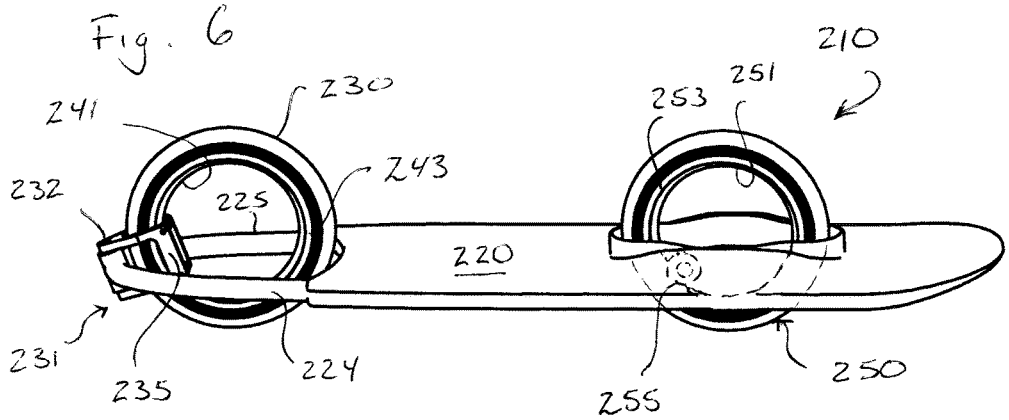
FIG. 6 is a side perspective view of yet another embodiment of a wheeled board device in accordance with the present invention.

Referring to FIG. 6, another embodiment of a wheeled board device 210 in accordance with the present invention is shown.

Device 210 is similar to device 110 of FIGS. 2-5, yet may differ in some ways. In device 210, the turning axle is place forward of and outside the envelope of the front wheel 230. Arms 225,225 are coupled to mounting assembly 231, which in turn houses the turning axle 232. Similar to the other mounting assemblies, mounting bracket 235 is coupled to inner rim 241 which rotatably supports outer rim 243.

Device 210 is preferably motorized. A friction-drive motor 255 (or the like) is preferably mounted at or below platform 220 and contacts the outer rim 253 below the platform for driving wheel 250. Inner rim 251 may be coupled to the platform. The position sensor, battery, control circuit and other drive features discussed above for device 110 are applicable to device 210.

It should be recognized that devices 10,110 and 210 may have a paired rear wheel, for lateral stability, or have two side-by-side tires mounted on the same wheel rim, etc., without departing from the present invention. This would give a single wheel structure that functions like a single wheel in many ways yet has two annular air chambers.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The invention claimed is:

1. A wheeled board device, comprising:

a board that is longer than wide a first wheel coupled towards a front of the board;

a second wheel coupled through the board, rearward of and substantially in-line with the first wheel;

a motor that drives the second wheel;

a position sensor that detects a position of the board; and an electronic control circuit;

wherein the device is configured such that when the first wheel is off the ground, the motor may drive the second wheel based on board position data from the position sensor.

2. The device of claim 1, wherein the driving of the second wheel is conducted through an auto-balancing feedback control loop based on the tilt angle position of the board as detected by the position sensor.

3. The device of claim 1, further comprising a pressure sensor for detecting the pressure from a rider asserted forward of the second wheel.

4. The device of claim 1, further comprising a pressure sensor coupled to the front wheel that detects when the front wheel is in contact with the ground.

5. The device of claim 2, wherein the driving of the second wheel via auto-balancing feedback control loop is initiated when the first wheel is off the ground for a predefined period of time.

6. The device of claim 2, wherein the driving of the second wheel via auto-balancing feedback control loop is initiated when the board is maintained above a threshold tilt angle for a predefined period of time.

7. The device of claim 5, wherein the auto-balancing feedback control loop driving of the second wheel is disabled and the device returns to manual propulsion when at least one of the following occurs: (a) the front wheel is brought back into contact with the ground and (b) the board is lowered below a threshold tilt angle.

8. The device of claim 1, wherein the platform includes a first section for a first foot located between the first and second wheels and a second section for a second foot located rearward of the second wheel.

9. The device of claim 1, wherein the first wheel is mounted in a biased-direction arrangement.

10. A wheeled board device, comprising:

a board that is longer than wide a first wheel coupled towards a front of the board;

a second wheel coupled through the board, rearward of and substantially in-line with the first wheel;

a motor that drives the second wheel;

a position sensor; and an electronic control circuit;

wherein the device is configured for a manual mode of operation and an auto-balancing mode of operation with auto-balancing occurring about the second wheel.

11. The device of claim 10, further comprising a pressure sensor for detecting the weight of a rider asserted forward of the second wheel.

12. The device of claim 10, further comprising a pressure sensor coupled to the front wheel that detects when the front wheel is in contact with the ground.

13. The device of claim 11, wherein the driving of the second wheel in auto-balancing mode is initiated when the first wheel is off the ground for a predefined period of time.

14. The device of claim 11, wherein the driving of the second wheel via auto-balancing mode is initiated when the board is maintained above a threshold tilt angle.

15. The device of claim 14, wherein the auto-balancing mode driving of the second wheel is disabled and the device returns to manual propulsion when at least one of the following occurs: (a) the front wheel is brought back into contact with the ground and (b) the board is lowered below a threshold tilt angle.

16. The device of claim 10, wherein the platform includes a first section for a first foot located between the first and second wheels and a second section for a second foot located rearward of the second wheel.

17. The device of claim 10, wherein the first wheel is mounted in a biased-direction arrangement.

18. A wheeled board device, comprising:

a board that is longer than wide a first wheel coupled towards a front of the board in a biased-direction arrangement;

a second wheel coupled through the board, rearward of and substantially in-line with the first wheel;

a motor, coupled to the second wheel, that drives the second wheel;

a pressure sensor located forward of the second wheel that detects pressure asserted by a rider forward of the second wheel; and an electronic control circuit coupled to the pressure sensor and the motor;

wherein the driving of the second wheel by the motor is based in part on data from the pressure sensor.

19. The device of claim 18, further comprising a position sensor that detects a tilt angle of the board, and wherein the device is configured for (a) a manual mode of operation and (b) an auto-balancing mode of operation when the first wheel is off the ground, the auto-balancing mode of operation occurring when the first wheel is off the ground, the driving of the second wheel during auto-balancing mode of operation being based, at least in part, on the tilt angle of the platform as detected by the position sensor.

20. The device of claim 18, wherein the platform includes a first section for a first foot located between the first and second wheels and a second section for a second foot located rearward of the second wheel.

* * * * *